US009834407B2

(12) United States Patent
Pelto-Huikko et al.

(10) Patent No.: US 9,834,407 B2
(45) Date of Patent: Dec. 5, 2017

(54) ELEVATOR

(71) Applicant: KONE CORPORATION, Helsinki (FI)

(72) Inventors: Raimo Pelto-Huikko, Vantaa (FI); Riku Lampinen, Helsinki (FI); Heidi Sederholm, Helsinki (FI)

(73) Assignee: KONE CORPORATION, Helsinki (FI)

( * ) Notice: Subject to any disclaimer, the term of this patent is extended or adjusted under 35 U.S.C. 154(b) by 354 days.

(21) Appl. No.: 14/310,516

(22) Filed: Jun. 20, 2014

(65) Prior Publication Data

US 2014/0299419 A1 Oct. 9, 2014

Related U.S. Application Data

(63) Continuation of application No. PCT/EP2011/073639, filed on Dec. 21, 2011.

(51) Int. Cl.
*B66B 7/12* (2006.01)
*B66B 1/34* (2006.01)

(52) U.S. Cl.
CPC ..... *B66B 1/3492* (2013.01); *B66B 7/12* (2013.01); *B66B 7/1261* (2013.01)

(58) Field of Classification Search
CPC ..... B66B 7/12; B66B 7/1261; B66B 1/3492
USPC ..... 187/251
See application file for complete search history.

(56) References Cited

U.S. PATENT DOCUMENTS

RE27,185 E * 10/1971 Berns et al. ..... B66B 1/3492 187/394
3,838,752 A * 10/1974 Berkovitz ..... B66B 11/08 184/15.1
4,735,295 A * 4/1988 Hochstrasser ..... B66B 1/3492 187/394
5,890,564 A * 4/1999 Olsen ..... B66B 7/123 187/250
6,454,054 B1 * 9/2002 Tanino ..... B66B 5/044 187/394

(Continued)

FOREIGN PATENT DOCUMENTS

CN 1376133 A 10/2002
CN 1705789 A 12/2005

(Continued)

*Primary Examiner* — Michael Riegelman
(74) *Attorney, Agent, or Firm* — Birch, Stewart, Kolasch & Birch, LLP

(57) ABSTRACT

The invention refers to an elevator comprising an elevator car and a suspension arrangement for suspending and/or moving an elevator car, which suspension arrangement comprises at least one suspension member, whereby at least one suspension member component is provided which component is to be applied to the suspension member for affecting the physical properties of the suspension member during the operation of the elevator. According to the invention the suspension member component applied to the suspension member comprises an component identifier which is an addition to the suspension member component which component identifier is configured to be identified visibly or via additional tools. The invention allows the unambiguous identification of the suspension member component and also the distribution of the component on the suspension member surface.

17 Claims, 1 Drawing Sheet

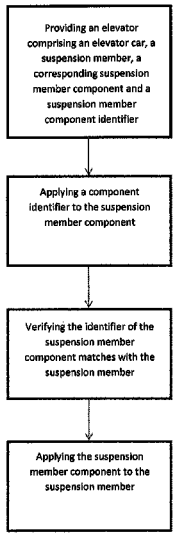

(56) References Cited

U.S. PATENT DOCUMENTS 6,653,943 B2 * 11/2003 Lamb ..... B66B 7/1223 324/513
7,117,981 B2 * 10/2006 Logan ..... B66B 7/1238 187/281
7,540,357 B2 * 6/2009 Finn ..... B66B 1/3492 187/394
7,857,106 B2 * 12/2010 Zapf ..... B66B 7/062 187/394
7,938,233 B2 * 5/2011 Kunz ..... B66B 1/3492 187/394
2002/0112926 A1 * 8/2002 Siberhorn ..... B66B 1/3492 187/394
2004/0010169 A1 1/2004 Banavali et al.
2004/0174161 A1 * 9/2004 Tausch ..... B66B 1/3492 324/207.22
2005/0245338 A1 11/2005 Eichhorn et al.
2006/0020416 A1 * 1/2006 Karasek ..... B66B 1/3492 702/141
2006/0135374 A1 6/2006 Cooper et al.
2006/0232789 A1 * 10/2006 Oh ..... B66B 1/3492 356/614
2007/0095617 A1 * 5/2007 Finn ..... B66B 1/3492 187/393
2011/0000746 A1 * 1/2011 Pelto-Huikko ..... B66B 7/062 187/254
2011/0308330 A1 * 12/2011 May ..... B66B 1/3492 73/862.69
2012/0061188 A1 * 3/2012 Aulanko ..... B66B 7/1261 187/254
2012/0181118 A1 * 7/2012 Choi ..... B66B 1/3492 187/393
2012/0312637 A1 * 12/2012 Aulanko ..... B66B 7/1261 187/254
2012/0318615 A1 * 12/2012 Aulanko ..... B66B 15/04 187/254
2014/0305744 A1 * 10/2014 Kere ..... B66B 7/1238 187/254
2015/0024891 A1 * 1/2015 Allwardt ..... B66B 7/08 474/204
2015/0102097 A1 * 4/2015 Schatt ..... B66B 1/3492 235/375
2015/0129367 A1 * 5/2015 Tyni ..... B66B 3/00 187/393

FOREIGN PATENT DOCUMENTS

TW 200410974 A 7/2004
WO WO 2009/026730 A1 3/2009
WO WO 2010/133768 A1 11/2010

* cited by examiner

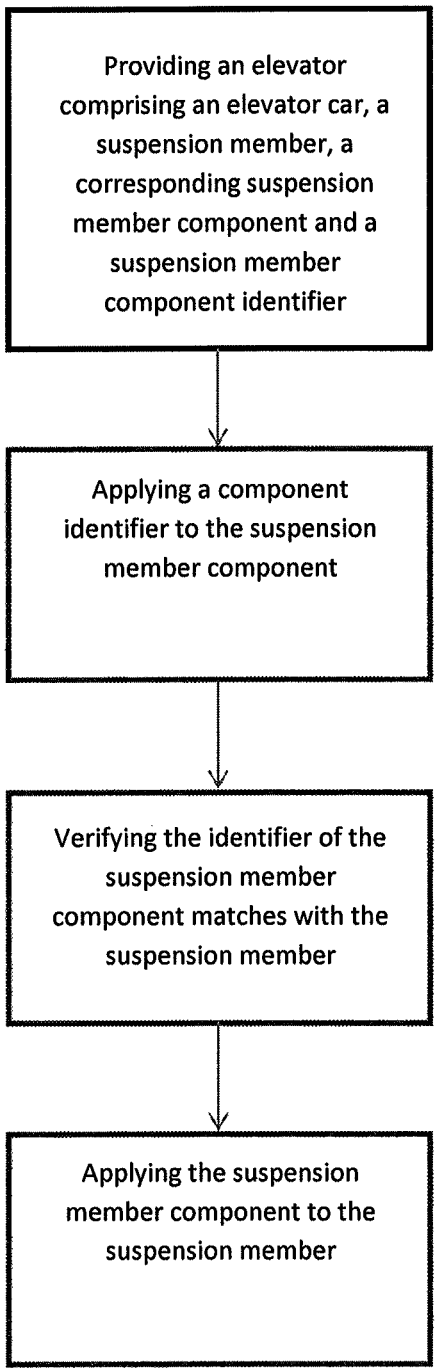
Providing an elevator comprising an elevator car, a suspension member, a corresponding suspension member component and a suspension member component identifier
Applying a component identifier to the suspension member component
Verifying the identifier of the suspension member component matches with the suspension member
Applying the suspension member component to the suspension member

ELEVATOR

CROSS REFERENCE TO RELATED APPLICATION

This application is a Bypass Continuation of PCT International Application No. PCT/EP2011/073639 filed on Dec. 21, 2011, which is hereby expressly incorporated by reference into the present application.

TECHNICAL BACKGROUND

The invention relates to an elevator comprising an elevator car and a suspension arrangement for suspending and/or driving an elevator car, which suspension arrangement comprises at least one suspension member.

Usually, these suspension members are a set of parallel independent elevator ropes, often steel wire ropes, coated or uncoated, but sometimes also belts, cogged belts, V-belts, chains and other suspension member geometries with a fibre or steel structure and possibly coatings made of plastics, rubber, textile or compounds thereof. The suspension member is used for at least partly suspending and/or moving the elevator car.

In elevator use most of these suspension members need any kind of suspension member component which is applied to the suspension member for affecting the physical properties thereof, as e.g. the frictional properties which are important in co-action with a traction sheave. Often these components are lubricants or grease being used to keep the suspension member smooth and to prolong its lifetime. As there are different types of suspension members different types of suspension member components are to be used which are configured to be used only with a special type of suspension member. This technology of the invention is per se known e.g. from WO 2010/133768. As the suspension member component essentially affects important properties of the suspension arrangement, e.g. the friction of the interface suspension member/traction sheave it is important not to use the wrong component in connection with a certain suspension member. The use of the wrong lubricant may lead to undue friction loss which again might result in uncontrolled rope slipping. This may have severe consequences related to elevator safety and also impacts the elevator performance as e.g. the car stopping accuracy etc.

OBJECT OF THE INVENTION

It is therefore object of the invention to provide an elevator and a method which ensure that the correct suspension member component is used in connection with the correlated suspension member.

SUMMARY OF THE INVENTION

This object is solved with an elevator according to claim 1 and with a method according to claim 10.

In line with the invention the suspension member component to be applied to the suspension member comprises a component identifier which is added to the suspension member component. Said component identifier is configured to be identified by the maintenance staff visibly or via auxiliary tools. The component identifier is e.g. dissolved or dispersed in the component. The component identifier is recognized by the maintenance staff or by the installation staff either before the component is applied to the suspension member e.g. during installation or during use of the elevator, e.g. during lubrication steps in maintenance.

The component identifier may also be used to verify the use of the correct component after the suspension member has applied to the suspension member and the component (e.g. a lubricant or grease) has become dark during use in the elevator. Further the component identifier may be used to improve the determination to which passages of the suspension member the component has been applied or where the component has already been worn off during use of the elevator. Therefore the component identifier could also be used to improve the evaluation of the lubrication quality, i.e. in how far the component is applied to all necessary passages of the suspension member.

The component identifier could e.g. be a material which dyes the component, e.g. colour pigments. The identifier may also be a material which can easily be detected by auxiliary means, e.g. detectors which are sensible in a certain wavelength range or apparatus which instigate an emission of radiation from the component identifier. Thus, the component identifier is preferably a fluorescent material, which emits radiation in a defined wavelength range when being instigated, e.g. by day-light or by special light, e.g. black-light. The advantage of fluorescent material is that the visible impression of the component itself or of the suspension member is not decisive for the recognition of the component. Therefore, the natural colour of the component or the colour the component has got during use of the elevator does not affect the fluorescent properties of the component identifier essentially, as the visible impression is not decisive for the determination of the component type. Therefore the blackening of grease as component during use of the elevator does not essentially interfere with the emission properties of the fluorescent material, whereas it does so with pigments emitting in the visible range. Further, a fluorescent material emits in a given wavelength or wavelength range which is widely unaffected by the type of the suspension member and its component during use of the elevator and can easily be detected by use of a corresponding recognition or instigation device (e.g. a black-light). Possible fluorescent materials are ATTO-Dyes (ATTO-TEC GmbH, Siegen), Alexa-Fluor (Molecular Probes, Invitrogen Corp.), cyanines (Cy3, Cy5), coumarines and TMRM+.

However, the component identifier could also be a colour material, e.g. pigments. Anyway, this material has to be so bright and defined in its dying properties that its colour will not be too much affected by the natural component colour and/or the colour of the suspension member to which the component is applied or by any colour changes thereof during use in the elevator.

The suspension member component may be a lubricant, e.g. a grease, a powder, e.g. talcum, a liquid as e.g. oil or any material adapted to influence the physical properties of the suspension member, e.g. the roughness, the friction properties against the traction sheave, the elasticity, the smoothness etc.

The suspension member may be for example one or a set of several of the following elements: A circular or non-circular hoisting rope, a belt, a V-belt, a cog-belt, a chain.

According to a preferred embodiment of the invention a suspension member identifier is provided. This suspension member identifier may be a tag which is provided in the suspension arrangement, e.g. in connection with the suspension arrangement but it could instead/additionally be a data file in a database of the elevator. The suspension member identifier comprises information about the type and/or physical properties of the suspension member and/or about adapted suspension member components to be used in connection with the particular suspension member. This suspension member identifier therefore allows the installation staff or maintenance staff the choice of at least one appropriate suspension member component in connection with the suspension member in question for the operation of the elevator.

BRIEF DESCRIPTION OF THE DRAWINGS

FIG. 1 is a block diagram of the method for matching a suspension member to a suspension member component.

The invention also refers to a method for determining matching suspension member/suspension member component combinations in an elevator comprising an elevator car and a suspension arrangement having at least one suspension member for suspending and/or moving the elevator car, in which method for the operation of the elevator a suspension member component is to be applied to the suspension member. According to the inventive method first a component identifier is applied to the suspension member component, then the suspension member component is applied to the suspension member, whereby it is checked beforehand that the identifier of the suspension member component matches with the suspension member.

By the use of a component identifier which can be added to the suspension member component already in the production site of the component it is possible to identify the suspension member component unambiguously which avoids hazardous mistakes in using the wrong component for the suspension member.

The component identifier should be homogenously soluble or dispersible in the suspension member component to indicate clearly the type of the component and the locations to which it is applied.

The invention may be used with new elevator installations but also in course of maintenance routines with lubricating steps or in course of re-roping.

Preferably a fluorescent material is used as component identifier because in this case the emitting characteristics of the fluorescent material are not affected by the natural colour of the component and/or of the suspension member. Furthermore, as in this case the emission of the fluorescent material is instigated only by a auxiliary instigating device there is no emission of the material in normal operation which could affect the normal operation or maintenance of the elevator. With respect to adapted fluorescent materials it is referred to the corresponding passages above. Fluorescent material improves the determination which type of component has been used and also the determination of how good the component is (still) applied to the suspension member. Therefore it can more easily be checked if the component layer on the suspension member is still thick enough or has been worn off during elevator use. Further it can easily be checked whether the component is still provided on all required passages of the suspension member(s).

In a preferred embodiment of the inventive method an identifier of the suspension member is provided at the elevator or in a database comprising elevator data. The suspension member identifier comprises information about the type and/or about physical properties of the suspension member and/or components which may be used in connection with the suspension member. Based on this data the installation staff or maintenance staff is able to derive the correct component for the suspension member in question. In this case the determination of the correct component for the suspension member is facilitated. In this case, the suspension member identifier could be advantageously provided in connection with the suspension arrangement.

In a preferred embodiment a tag is connected to the suspension arrangement, particularly to the suspension member as suspension member identifier. Anyway, the suspension member identifier may also or alternatively be stored in a database of the elevator or of the maintenance company, which makes the necessary suspension member data available without providing any tags or info-material at the elevator site, where it can be lost or soiled.

In order to check up the correct material-pairs of suspension members and suspension member components a table with matching combinations of suspension members and suspension member components may be stored in a database of the elevator or of a maintenance centre and/or may be provided at the elevator site. Preferably these data are provided in a database which is accessible by the maintenance staff to ensure that the correct component is used for the suspension members of the elevator in question.

If the suspension member identifier is available via a database the maintenance staff could care for the correct suspension member components before heading to the elevator site.

Preferably, a table with matching combinations of suspension members and suspension member components is stored in a database of the elevator or of a maintenance centre.

The invention claimed is:

1. An elevator comprising:

an elevator car; and a suspension arrangement for suspending and/or moving the elevator car, wherein the suspension arrangement comprises at least one suspension member, each suspension member comprising a suspension member component for affecting physical properties of the suspension member, wherein the suspension member component is a lubricant, and wherein the suspension member component comprises a component identifier configured to be identified visibly or via additional tools.

2. The elevator according to claim 1, wherein the component identifier is a material with fluorescent properties.

3. The elevator according to claim 2, wherein the component identifier is soluble in the suspension member component.

4. The elevator according to claim 2, wherein the component identifier is dispersible in the suspension member component.

5. The elevator according to claim 1, wherein the component identifier comprises color pigments.

6. The elevator according to claim 5, wherein the component identifier is soluble in the suspension member component.

7. The elevator according to claim 5, wherein the component identifier is dispersible in the suspension member component.

8. The elevator according to claim 1, wherein the component identifier is soluble in the suspension member component.

9. The elevator according to claim 8, wherein the component identifier is dispersible in the suspension member component.

10. The elevator according to claim 1, wherein the component identifier is dispersible in the suspension member component.

11. The elevator according to claim 1, further comprising a suspension member identifier, wherein the suspension member identifier provides information about the type and/or physical properties of the at least one suspension member and/or suspension member component to be used in connection with the at least one suspension member.

12. The elevator according to claim 1, wherein the suspension arrangement comprises a set of separate hoisting ropes as suspension members.

13. A method for matching a suspension member to a suspension member component in an elevator, the elevator comprising an elevator car and a suspension arrangement, the suspension arrangement having at least one of said suspension member for suspending and/or moving the elevator car and a corresponding of said suspension member component for each of said at least one suspension member, where the suspension member component is a lubricant, said method comprising the steps of:

first, applying a component identifier to each of the suspension member components; and then, applying each of the suspension member components to the corresponding suspension members, wherein before applying each of the suspension member components to the corresponding suspension members, verifying that the component identifier matches with the corresponding suspension member.

14. The method according to claim 13, wherein the component identifier is a fluorescent material and wherein the step of verifying comprises detecting emissions of the component identifier.

15. The method according to claim 13, further comprising providing a suspension member identifier to the elevator or providing a database, wherein the suspension member identifier is stored in said database.

16. The method according to claim 15, wherein a tag is connected to the suspension arrangement as the suspension member identifier.

17. The method according to claim 13, wherein a table with matching combinations of suspension members and suspension member components is stored in a database.

* * * * *